US011555373B2

(12) United States Patent
Krug

(10) Patent No.: US 11,555,373 B2
(45) Date of Patent: Jan. 17, 2023

(54) PROCESS FOR ISOLATING A HORIZONTAL TIE-IN PIPELINE OF AN INACTIVE HYDROCARBON-PRODUCING WELL FROM A MAIN PIPELINE

(71) Applicant: John Robert Karl Krug, Strathmore (CA)

(72) Inventor: John Robert Karl Krug, Strathmore (CA)

( * ) Notice: Subject to any disclaimer, the term of this patent is extended or adjusted under 35 U.S.C. 154(b) by 0 days.

(21) Appl. No.: 17/235,346

(22) Filed: Apr. 20, 2021

(65) Prior Publication Data

US 2021/0238949 A1 Aug. 5, 2021

Related U.S. Application Data

(63) Continuation of application No. 16/013,806, filed on Jun. 20, 2018, now abandoned.

(60) Provisional application No. 62/523,654, filed on Jun. 22, 2017.

(51) Int. Cl.

| | |
|---|---|
| ***E21B 33/12*** | (2006.01) |
| ***E21B 37/00*** | (2006.01) |
| ***E21B 47/09*** | (2012.01) |
| ***E21B 41/00*** | (2006.01) |
| ***E21B 23/06*** | (2006.01) |
| ***E21B 37/04*** | (2006.01) |

(52) U.S. Cl.

CPC ..... *E21B 33/12* (2013.01); *E21B 23/06* (2013.01); *E21B 33/1208* (2013.01); *E21B 37/00* (2013.01); *E21B 37/04* (2013.01); *E21B 41/0035* (2013.01); *E21B 47/09* (2013.01)

(58) Field of Classification Search

CPC ..... E21B 41/0035; E21B 41/0042

See application file for complete search history.

(56) References Cited

U.S. PATENT DOCUMENTS

| | | | |
|---|---|---|---|
| 1,875,414 | A | 9/1932 | Burt |
| RE21,668 | E | 12/1940 | Carroll |
| 2,966,946 | A | 10/1958 | McCulloch et al. |
| 3,215,208 | A | 11/1965 | Tamplen |
| 3,403,694 | A | 10/1968 | Brown |
| 3,642,064 | A | 2/1972 | Rosenthal |

(Continued)

FOREIGN PATENT DOCUMENTS

| | | |
|---|---|---|
| CA | 2170711 A1 | 9/1996 |
| WO | WO 2012/177909 | 12/2012 |

*Primary Examiner* — Robert E Fuller

(74) *Attorney, Agent, or Firm* — Klarquist Sparkman, LLP

(57) ABSTRACT

A method for isolating a horizontal tie-in pipeline of an inactive hydrocarbon-producing well from a main pipeline to prevent flow of hydrocarbons into the tie-in pipeline includes the steps of: identifying a location of a junction of the tie-in pipeline and the main pipeline and cleaning the tie-in pipeline by deploying a locating and cleaning assembly into the tie-in pipeline, withdrawing the locating and cleaning assembly, deploying a plug device having a longitudinally extending forward probe and a sealing element to the location of the junction, and remotely actuating the sealing element. The locating and cleaning device includes a pipeline junction sensing element longitudinally extending from a forward end of the locating and cleaning device. The sensing element is connected to a valve which, when open, relieves pressure in the locating and cleaning assembly as an indicator of the location of the junction.

12 Claims, 9 Drawing Sheets

(56) References Cited

U.S. PATENT DOCUMENTS

| | | | | |
|---|---|---|---|---|
| 3,812,911 | A | 5/1974 | Vann | |
| 4,262,702 | A | 4/1981 | Streich | |
| 4,432,419 | A | 2/1984 | Streich | |
| 4,484,602 | A | 11/1984 | Guthrie | |
| 4,869,324 | A | 9/1989 | Holder | |
| 6,338,390 | B1 | 1/2002 | Tibbitts | |
| 6,527,067 | B1 * | 3/2003 | Ravensbergen .... | E21B 41/0035 175/73 |
| 8,091,633 | B2 | 1/2012 | Al-Khamis | |
| 9,435,172 | B2 | 9/2016 | Oettli et al. | |
| 10,683,732 | B2 | 6/2020 | Al-Mulhem | |
| 2011/0036564 | A1 | 2/2011 | Williamson | |
| 2014/0116728 | A1 | 5/2014 | Zhou | |

* cited by examiner

PROCESS FOR ISOLATING A HORIZONTAL TIE-IN PIPELINE OF AN INACTIVE HYDROCARBON-PRODUCING WELL FROM A MAIN PIPELINE

CROSS-REFERENCE TO RELATED APPLICATION

This application is a continuation of U.S. patent application Ser. No. 16/013,806 filed on Jun. 20, 2018, which claims the benefit of U.S. Provisional Application Ser. No. 62/523,654 filed on Jun. 22, 2017, the entire disclosures of which are incorporated herein by reference in their entirety.

FIELD

The disclosure relates to the field of pipeline maintenance and more specifically relates to isolation and suspension of pipeline branches known as "tie-ins."

BACKGROUND

Oil and gas wells which are actively producing hydrocarbon products are typically provided with branch pipelines which join another pipeline. Similarly, disposal lines for water and acid gas may also be connected in a similar fashion. Such branch pipelines are known in the art as "tie-ins." Tie-ins usually extend underground from a producing well to a connection point where the hydrocarbons produce by the producing well join the operating pipeline, which may be a larger pipeline. The joint of the tie-in may be provided as a "T" (when the tie-in joins at a right angle) or a "Y" (when the tie-in joins at an angle other than a right angle).

One aspect of maintenance of hydrocarbon producing wells includes tasks which relate to a status known as "well suspension." Well suspensions have typically involved temporarily halting production for the purposes of performing workover tasks, after which the producing well is brought back on line. Well suspensions for extended periods of time usually are economically influenced by a critical well failure or uneconomic production. Lower resource prices have incentivized owners to consider temporarily halting production for a significant period with the intention of re-starting production when resource prices increase. One aspect of well suspension includes shutdown and of the corresponding pipeline. Regulations relating to proper suspension of the pipeline and corresponding tie-in exists in various jurisdictions.

A number of technologies for temporarily halting the flow of hydrocarbons or other fluids in wellbores, pipelines and other conduits have been described.

U.S. Pat. No. 8,091,633, incorporated herein by reference in its entirety, describes a tool used for treating and/or maintaining a wellbore that includes acoustic transducers for locating a lateral wellbore that intersects a primary wellbore. The tool includes a sensor to sense water and/or gas, and if the water and/or gas enters the primary wellbore from a lateral wellbore, the lateral to primary intersection can be identified by correlating information from the sensor and acoustic transducers. If needed, the tool can be used to plug the water and/or gas supplying lateral wellbore. The tool may include a bendable sub portion for orienting a portion of the tool for insertion into the lateral wellbore and a plug section for plugging the lateral wellbore after insertion therein.

U.S. Pat. No. 4,484,602, incorporated herein by reference in its entirety, describes a method and apparatus for detecting and sealing leaks in a sewer branch pipe including a packer member which travels along the main sewer pipe by remote control. When the packer is correctly located, the main pipe region surrounding the branch entrance is sealed off. The packer is rotated until a slot in the packer is orientated to the branch. An inflatable tube in the packer is then inflated, causing the tube to elongate and enter the branch. The remote end of the tube forms a seal against the inside of the branch so that the area of the branch near the junction with the main pipe is included in the sealed off area. Fluid can be pumped into the sealed off space to detect if a leak is present; in which case a sealant fluid is pumped into the space. Afterwards, the tube can be deflated and retracted and the traveller repositioned at the next branch. The disclosure includes a method of detecting and sealing leaks, in which an inflatable tube is used to provide a means to enter the branch, and to seal the branch away from its junction with the main pipe.

U.S. Pat. No. 4,869,324, incorporated herein by reference in its entirety, describes modifications for both single unit and dual unit inflatable packers or bridge plugs permitting such inflatable tools to be inserted in a well through the primary tubing string which in turn is suitably sealably anchored in the well above the producing formations. The inflatable tool is inserted into the well on a conduit, such as coiled tubing, and fluid pressure transmitted through the conduit is utilized to effect the expansion and setting of the inflatable elements of the inflatable tool. The conduit is connected to the inflatable tool by a fluid pressure operated release mechanism and, following the inflation of the inflatable element or elements, the conduit may be utilized to supply treatment fluid or cementing fluid to a formation isolated by the inflatable tool. Alternatively, the conduit may be disconnected from the inflatable tool and retrieved from the well to permit the inflated tool to maintain a production formation in an isolated condition, to prevent further leakage of a leaking packer, or to permit wireline installation of a choke to regulate the amount of flow into or out of a producing or injection formation isolated by the inflated tool. Applications of the packers and bridge plugs are focused on deployment in production or injection tubing.

US Published Patent Application No. 2011/0036564, incorporated herein by reference in its entirety, describes a bridge plug that can be deployed downhole and retrieved using a retrieval tool disposed on jointed or coiled tubing or on another bridge plug. Internally, the bridge plug has a sleeve that is movable on a stem of the plug's tailpiece. When in a first position, the sleeve prevents fluid communication through ports in the stem so that circulated fluid from the retrieval tool can be used to clear debris from the plug during retrieval. When the retrieval tool engages the sleeve in the plug, pulling up on the tool moves the sleeve to an intermediate position in which fluid pressure is equalized across the plug. Further pulling up on the tool locks the sleeve in a further position on the stem so that circulated fluid from the retrieval tool will pass directly to the stem's ports. Movement of the sleeve by the retrieval tool also releases the engaged slips and packing element on the bridge plug's mandrel. Operations envisioned for the bridge plug include: acidizing, fracturing, cementing, casing pressure tests, wellhead replacement, and zonal isolation.

U.S. Pat. No. 9,435,172, incorporated herein by reference in its entirety, describes a downhole tool conveyed via tubing within a wellbore at a wellsite. The hydraulic tool is driven by fluid pumped to the hydraulic tool via the tubing.

The downhole tool further comprises a valve in fluid communication between the tubing and the hydraulic tool. The valve is configurable in the wellbore between an expanded position, establishing a bypass diverting at least a portion of the pumped fluid away from the hydraulic tool, and a compressed position, closing the bypass.

U.S. Pat. No. 6,338,390, incorporated herein by reference in its entirety, describes an apparatus and methods for drilling subterranean formations with a rotary-type drill bit. Oscillation is produced in the drill string, drill bit or cutting element, in an axial and/or torsional direction, to produce formation chips that have both thin portions and thick portions. More specifically, the oscillations cause a cutting element of the drill bit to engage the formation to various degrees, resulting in a chip that has varying thicknesses which facilitate fracture of the chip along its thinner portions, thereby reducing the likelihood of adherence of the formation chips to the drill bit or cutting element.

U.S. Pat. No. 1,875,414, incorporated herein by reference in its entirety, describes a washing and cementing device for well casings. The device is fitted to the lower end of a well casing and has a stem which triggers a valve upon contact with an obstruction in the wellbore.

Canadian Patent 2,170,711, incorporated herein by reference in its entirety, describes a locator and setting tool which is capable of locating and setting a barrier member within a cased wellbore. The tool has a casing collar locator and a packer setting assembly. The casing collar locator includes a detector to identify the locations of the casing collars and provides a signal to identify the locations. The setting tool has a motor and an associated linear drive section to operate the packer assembly.

PCT Publication No. WO 2012/177909, incorporated herein by reference in its entirety, describes a device which includes a first locating system configured to generate to sense an electromagnetic field emanating from a sonde associated with a drill head, and a second locating system including a global positioning system. The locator device includes a display on the locating system configured to display a map of the area in which the locator device resides based on a location detected by the global positioning system. The locator device also includes control electronics configured to, upon receipt of an input from a user, record location data in a memory associated with the locator device for use by a horizontal directional drilling control system.

There continues to be a need for development of processes and devices for installing a retrievable pipeline bridge plug which are suitable for deployment during well suspension operations.

SUMMARY

In accordance with the disclosed embodiments, there is provided a method for isolating a tie-in pipeline of an inactive hydrocarbon-producing well from a main pipeline to prevent flow of hydrocarbons into the tie-in pipeline. The method comprises the steps of: a) deploying coil tubing into the tie-in line to transport a retrievable plug to the junction where the tie-in line joins the main pipeline, wherein the plug is provided with a remotely actuated sealing element; b) remotely activating the sealing element to prevent the flow of hydrocarbons between the tie-in line and the main pipeline; c) detaching the plug from the coil tubing; and d) withdrawing the coil tubing from the tie-in line.

In some embodiments, the method comprises the step of pumping fluid and/or gas out of the tie-in line and pumping preservative fluid or gas into the tie-in line.

In some embodiments, the plug comprises a junction-sensing element.

In some embodiments, the junction-sensing element is provided by one or more fins biased for extension outward from the forward end of the body of the plug when the forward end of the plug emerges into the main pipeline from the tie-in line at the junction.

In some embodiments, the extension of the fins is coupled to a mechanism for releasing pressure inside the coil tubing to indicate that the junction has been reached by the plug and that the plug is at or near its intended point for actuation of the sealing element.

In some embodiments, the junction-sensing element is an elongated probe extending outward from the forward end of the plug.

In some embodiments, the probe is coupled to a mechanism for releasing pressure inside the coil tubing to indicate that the junction has been reached by the plug and that the plug is at or near its intended point for actuation of the sealing element.

In some embodiments, the probe is formed of a material which is dissolvable in hydrocarbons.

In some embodiments, the plug comprises at least two sealing elements.

In some embodiments, the plug includes an articulating joint between at least two of the sealing elements.

In some embodiments, the method further comprises the step of e) retrieving the plug at a point in time when it is desired to reactivate the well.

Another aspect of the disclosed embodiments is a method for isolating a tie-in line of an inactive hydrocarbon-producing well from a main pipeline to prevent flow of hydrocarbons into the tie-in line, the method comprising: a) remotely determining a junction where the tie-in line joins the main pipeline; b) deploying coil tubing into the tie-in line to transport a retrievable plug to the junction, wherein the plug is provided with a remotely actuated sealing element; c) remotely activating the sealing element to prevent the flow of hydrocarbons between the tie-in line and the main pipeline; d) detaching the plug from the coil tubing; and e) withdrawing the coil tubing from the tie-in line.

In some embodiments, the method further comprises the step of pumping fluid and/or gas out of the tie-in line and pumping preservative fluid or gas into the tie-in line.

In some embodiments, step a) comprises using a locating and cleaning assembly to clean the tie-in line and remotely determine the location of the junction.

In some embodiments, the locating and cleaning assembly includes an outwardly extending probe for sensing contact with the inner sidewall of the main pipeline.

In some embodiments, the outwardly extending probe is operatively connected to a valve which, when open, relieves pressure in the locating and cleaning assembly as an indicator that the junction location has been reached.

In some embodiments, the method further comprises transmitting a signal from a locator on the locating and cleaning assembly for detection at the surface.

In some embodiments, the plug comprises a junction-sensing element.

In some embodiments, the junction sensing element is provided by one or more fins biased for extension outward from the body of the plug when the forward end of the plug emerges into the main pipeline from the tie-in line at the junction.

In some embodiments, the extension of the fins is coupled to a mechanism for releasing pressure inside the coil tubing to indicate that the junction has been reached by the plug and that the plug is at or near its intended point for actuation of the sealing element.

In some embodiments, the junction sensing element is an elongated probe extending outward from the forward end of the plug.

In some embodiments, the probe is coupled to a mechanism for releasing pressure inside the coil tubing to indicate that the junction has been reached by the plug and that the plug is at or near its intended point for actuation of the sealing element.

In some embodiments, the probe is formed of material which is dissolvable in hydrocarbons.

In some embodiments, the plug comprises at least two sealing elements.

In some embodiments, the plug includes an articulating joint between at least two of the sealing elements.

Another aspect of the disclosed embodiments is a plug device for isolating a tie-in line of an inactive hydrocarbon-producing well from a main pipeline to prevent flow of hydrocarbons into the tie-in line. The plug device comprising a generally cylindrical body comprising: a pipeline junction-sensing element and a remotely activatable sealing element.

In some embodiments, the junction-sensing element is provided by one or more fins biased for extension outward from the body of the plug when the forward end of the plug emerges into the main pipeline from the tie-in line at the junction.

In some embodiments, the extension of the fins is coupled to a mechanism for releasing pressure inside the coil tubing to indicate that the junction has been reached by the plug and that the plug is at or near its intended point for actuation of the sealing element.

In some embodiments, the junction-sensing element is an elongated probe extending outward from the forward end of the plug.

In some embodiments, the probe is coupled to a mechanism for releasing pressure inside the coil tubing to indicate that the junction has been reached by the plug and that the plug is at or near its intended point for actuation of the sealing element.

In some embodiments, the probe is formed of material which is dissolvable in hydrocarbons.

In some embodiments, the device comprises at least two sealing elements.

In some embodiments, the device comprises an articulating joint between at least two of the sealing elements.

Another aspect of the disclosed embodiments is a pipeline junction locating and cleaning device configured for connection to coil tubing for conveyance of the device into a tie-in line for cleaning the tie-in line and locating a junction where the tie-in line joins a main pipeline, the device comprising: a) a pipeline junction-sensing component; b) a pipeline cleaning component connected to the pipeline junction sensing component; and c) a locator connected to the pipeline cleaning component.

In some embodiments, the pipeline junction-sensing element comprises an outwardly extending probe for sensing contact with the inner sidewall of the main pipeline.

In some embodiments, the probe is operatively connected to a valve which, when open, relieves pressure in the locating and cleaning assembly as an indicator of that the junction is located.

In some embodiments, the valve is a ball valve.

In some embodiments, the pipeline junction-sensing component is defined by one or more ports adjacent to the probe.

In some embodiments, the pipeline junction-sensing component is connected to the pipeline cleaning component with a first swiveling connector and the pipeline cleaning component is connected to the coil tubing with a second swiveling connector.

BRIEF DESCRIPTION OF THE DRAWINGS

Various objects, features and advantages of the disclosed technology will be apparent from the following description of particular embodiments, as illustrated in the accompanying drawings. The drawings are not necessarily to scale, emphasis instead being placed upon illustrating the principles of various embodiments of the technology. Similar reference numerals indicate similar components.

DETAILED DESCRIPTION

Rationale and Advantages

Figure 1:
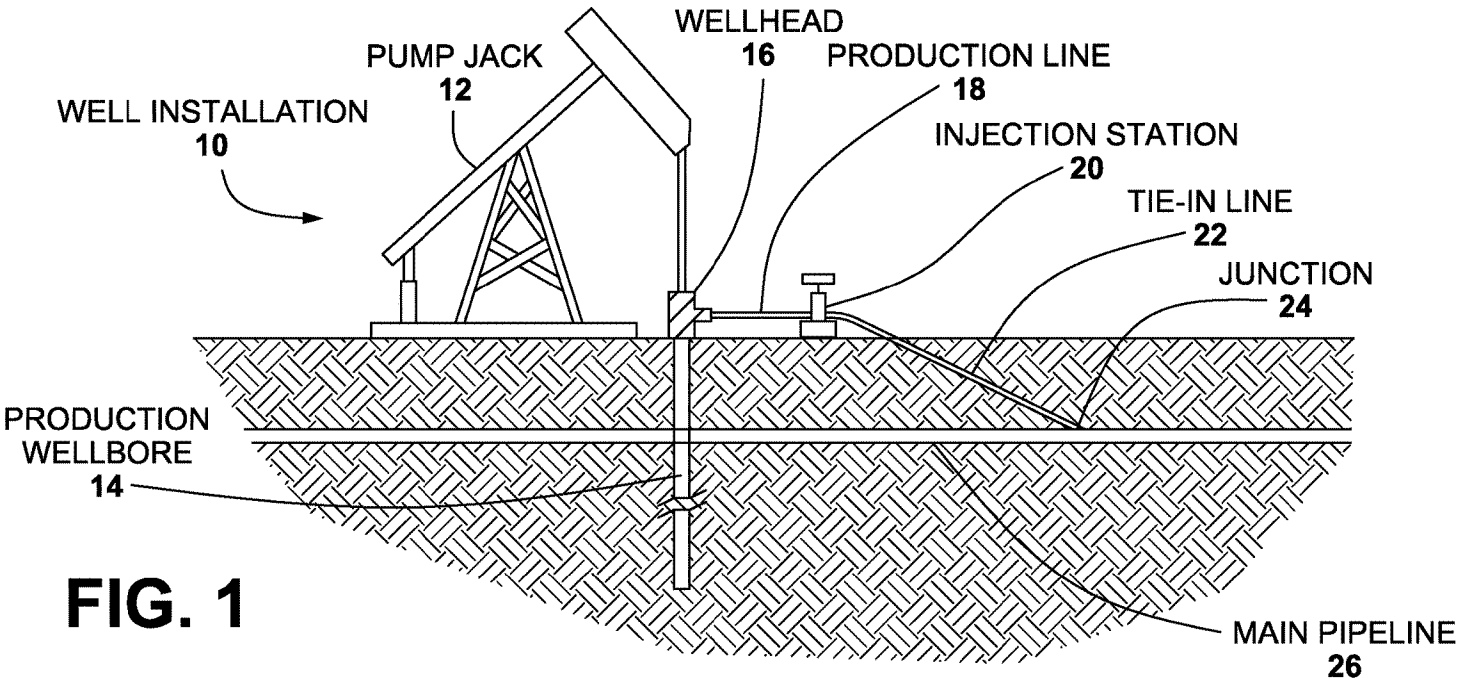
FIG. 1 is a schematic illustration of a well installation 10 which has a tie-in line 22 extending from the injection station 20 to a main pipeline 26.

Underground tie-in branch lines of inactive hydrocarbon-producing wells are most often not properly suspended in accordance with regulations as this requires excavation of the tie-in and subsequent treatment of the inactive pipeline. However, if the pipeline tie-ins are not properly suspended and no flow occurs through them, there is an increased probability that corrosive fluids will accumulate inside the pipeline and such an occurrence can cause a pipeline failure.

Historically, underground tie-ins are not suspended in accordance with regulations and the risk of pipeline failure is accepted by the owner of the suspended well. If the owner decides to comply with regulations, the pipeline connection is excavated and the inactive line is properly abandoned. Currently, in view of the negative media reports of pipeline spills, further pressure is placed on regulators to bring violators into compliance with existing regulations relating to inactive pipelines.

The inventor has discovered a solution to this problem which avoids the costly process of excavation, and the time associated with garnering appropriate approvals for excavation. The solution includes the use of a combination of technologies in a process for properly suspending an inactive section of a pipeline to bring it into compliance with regulations. In this process, a retrievable and remotely activatable plug is conveyed to the tie-in junction with the main pipeline, using coil tubing. The plug is provided with a mechanism for locating or confirming the location of the tie-in junction. The plug is sealed against the walls of the pipeline tie-in with a sealing element such as a hydraulically activatable packer element which is remotely activated. The plug may be unsealed and retrieved later if re-activation of the pipeline is desired. This operation is performed at the access point of the tie-in portion of the well, near the well itself. As such, there is no need to excavate any land above the location of the tie-in joint.

This process provides a number of significant advantages to the owner of the pipeline tie-in. As noted above, no excavation is required because operations are conducted from the wellhead site. This prevents significant damage to cropland in situations where a pipeline to be suspended is located in an agricultural area as well as negating the possibility of incidental damage to other pipelines which may be present in the area. Negotiations with land owners for access to the tie-in connection site are not required, nor are crossing and proximity agreements from other industries nearby. These advantages provide significant savings in terms of time and expense and greatly lessen the risk of performing a suspension operation in accordance with regulations.

Various aspects of the technology will now be described with reference to the figures. For the purposes of illustration, components depicted in the figures are not necessarily drawn to scale. Instead, emphasis is placed on highlighting the various contributions of the components to the functionality of various aspects of the technology. A number of possible alternative features are introduced during the course of this description. It is to be understood that, according to the knowledge and judgment of persons skilled in the art, such alternative features may be substituted in various combinations to arrive at different embodiments of the technology. Similar reference numerals are used to indicate similar components appearing in different embodiments, wherever possible.

Description of a Process and Device for Installation of a Retrievable Bridge Plug in a Tie-In To facilitate an understanding of the disclosed technology, a typical hydrocarbon producing installation will first be described, followed by a description of different embodiments of a device and process for installation of a bridge plug for isolation of a tie-in line from a main pipeline to enable removal of hydrocarbons from the tie-in line. FIG. 1 is a schematic illustration of a hydrocarbon producing well installation 10 which includes a pump jack 12 for pumping hydrocarbons out from a production wellbore 14. The produced hydrocarbons exit the wellhead 16 via a production line 18 which extends to an injection station 20 to provide an entry point for the produced hydrocarbons to enter a tie-in line 22. The tie-in line 22 extends to a junction 24 with a main pipeline 26.

Figure 2B:
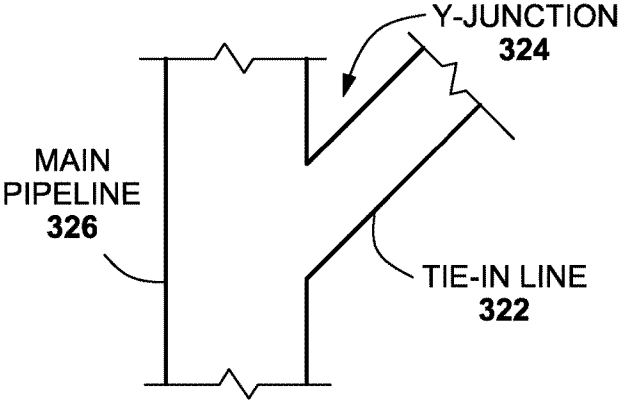
FIG. 2B is a schematic illustration of an arbitrary longitudinal cross-section of a Y-junction 324 for joining a tie-in line 322 to a main pipeline 326.
Figure 2A:
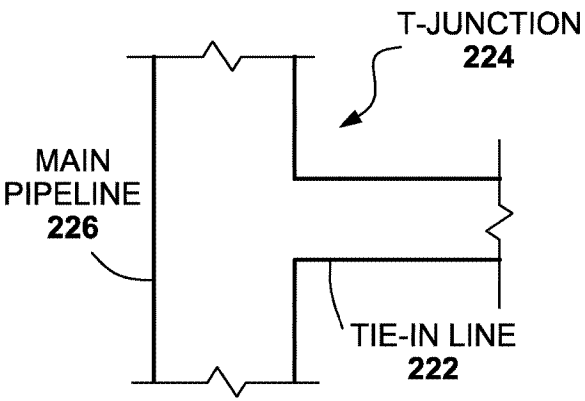
FIG. 2A is a schematic illustration of an arbitrary longitudinal cross-section of a T-junction 224 for joining a tie-in line 222 to a main pipeline 226.

FIGS. 2A and 2B illustrate two types of junctions. FIG. 2A illustrates a T-junction (or "tee-junction") 224 formed by joining a tie-in line 222 to a main pipeline 226 at a substantially perpendicular angle. FIG. 2B illustrates a Y-junction (or "Wye-junction") 324 formed by joining a tie-in line 322 to a main pipeline 326 at an angle which is not a substantially perpendicular angle (in this case, approximately a 45 degree angle).

Figure 3:
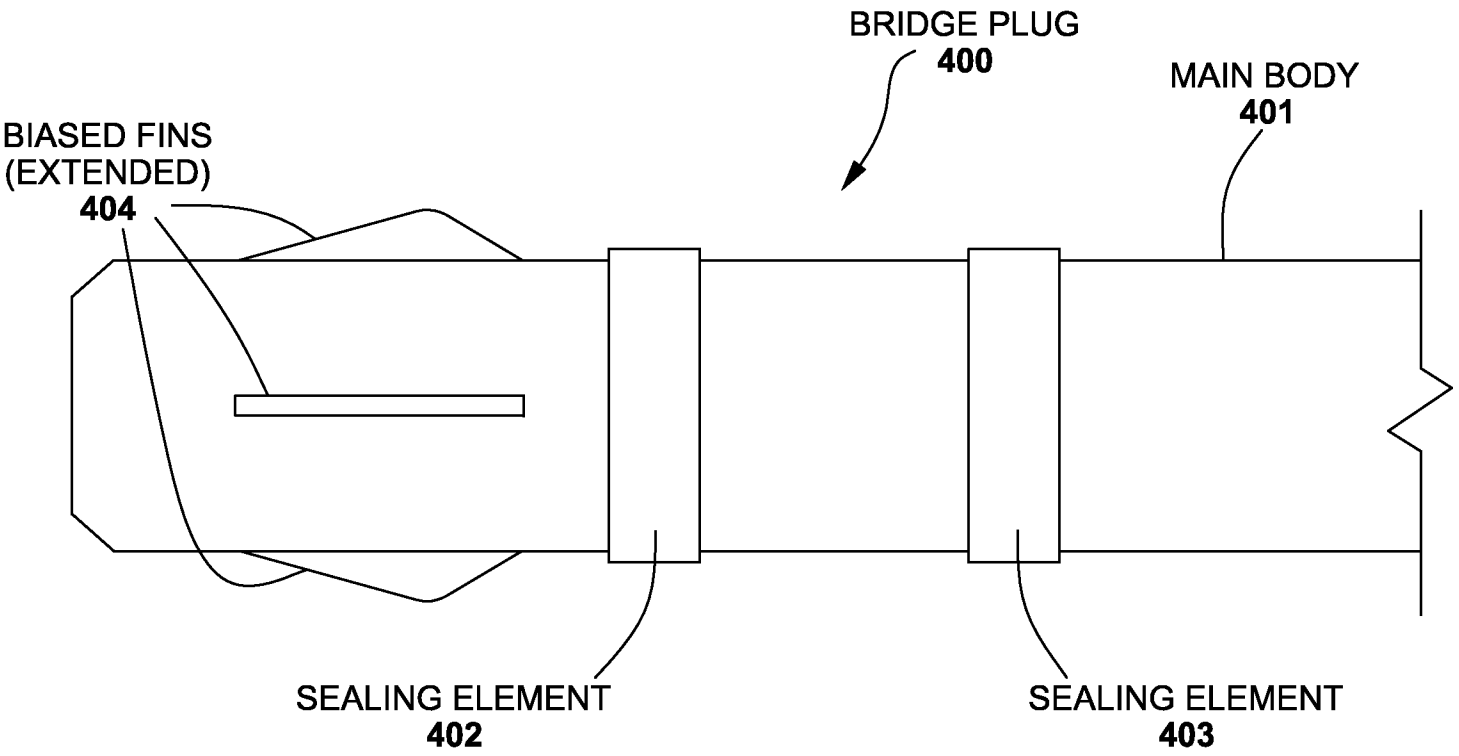
FIG. 3 is a side elevation view of one embodiment of a bridge plug 400.

FIG. 3 illustrates a side view of one embodiment of a bridge plug 400 configured for use with embodiments of the process described herein for isolating fluid and/or gas flow from a tie-in line of a hydrocarbon-producing well from a main pipeline. This bridge plug 400 has a main body 401 which is connectable to coil tubing (not shown) for conveyance of the bridge plug 400 to the tie-in junction site (not shown). The bridge plug 400 has a pair of remotely activatable sealing elements 402 and 403 in the form of inflatable packers or other known sealing elements which are arranged circumferentially around the main body 401. These sealing elements 402 and 403 are remotely activatable. While two sealing elements 402 and 403 are shown in this example embodiment, it may be possible to provide only a single sealing element or more than two sealing elements in alternative embodiments. One variation which uses two sealing elements provides an articulating joint between the two sealing elements in order to allow the bridge plug to more efficiently traverse bends in the tie-in line (not shown).

Figure 4:
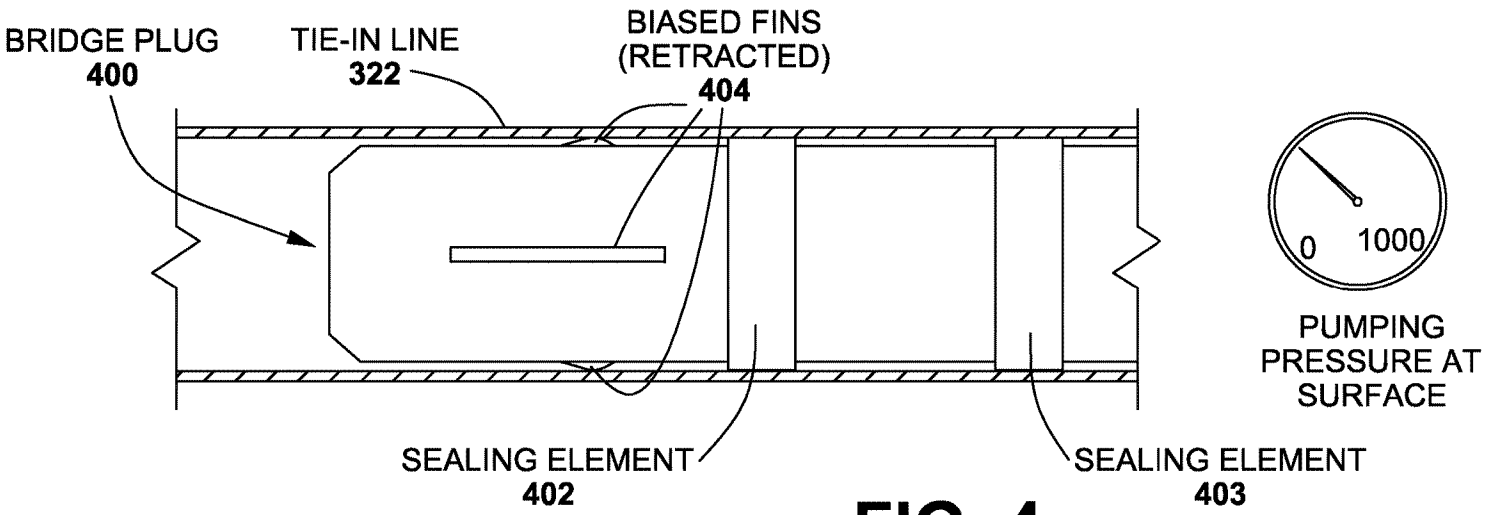
FIG. 4 is a partial side view of the bridge plug 400 of FIG. 3 inside a tie-in line 322.
Figure 5:
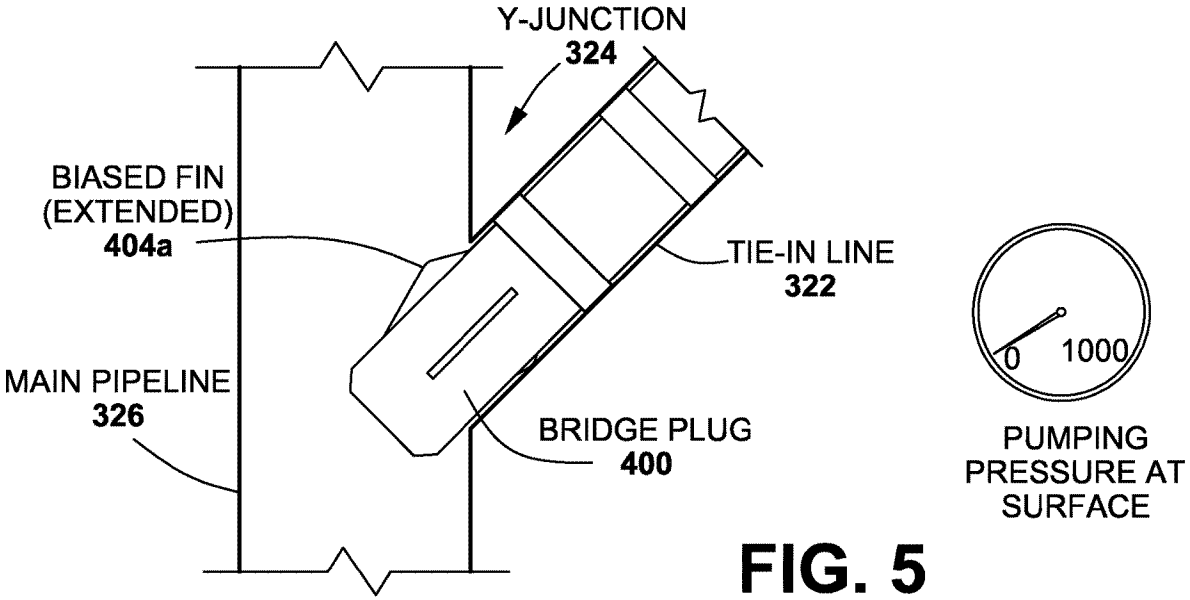
FIG. 5 is a partial side view of the bridge plug 400 arriving at a Y-junction 324 showing extension of one of the biased fins 404.

This embodiment of the bridge plug 400 includes a set of retractable fins 404 near its forward end which are biased to extend out of the body of the bridge plug 400. These biased fins 404 retract into the body of the bridge plug 400 with application of force against them. Therefore, as indicated in FIG. 4, while the bridge plug 400 is being conveyed by coil tubing into a tie-in line 322, the biased fins 404 are forced into the retracted position (inside the body of the bridge plug 400) as they encounter the inner sidewall of the tie-in line 322. It is seen in FIG. 5 that as soon as the forward end of the bridge plug 400 reaches the Y-junction 324, the top fin 404*a* has moved completely into the cavity of the main pipeline 326 and therefore extends out of the body of the bridge plug, depressuring the coil tubing and indicating the location of the junction 400.

The bridge plug 400 is configured to detect the extension of the fins 404 by releasing pressure from the bridge plug 400 when extension of the fins 404 occurs. Typical pressure at the surface is illustrated in both FIG. 4 and FIG. 5 and it is seen that a pressure drop is detectable at the surface as soon as fin 404*a* is extended. This provides an indication that the bridge plug 400 has reached the Y-junction 324. At this point, outward conveyance of the bridge plug 400 is halted. The bridge plug 400 is then drawn back by a pre-determined distance to avoid having a significant portion of the head of the bridge plug 400 extending into the cavity of the main pipeline 324. When an appropriate position for the bridge plug 400 is reached (for example, with the forward sealable element 402 within about 6 inches of the tie-in junction 324 the fins 404 are retracted, causing pumping pressure to be re-established. The sealable elements 402 and 403 are then activated by a mechanism such as hydraulic pressure to seal the bridge plug 400 against the inner sidewall of the tie-in line 322. This isolates flow of hydrocarbons from the main pipeline 326 into the tie-in line 322. This process allows the well operator to properly suspend production of the well in accordance with regulations.

Setting of the bridge plug 400 may be confirmed by a positive pressure test using inert fluid pumped into the tie-in line via the coil tubing. After the bridge plug 400 is set, it is released from the coil tubing and an inert fluid or gas such as nitrogen or water is used to purge the tie-in line 322 of corrosive fluid. The isolation of the tie-in line 322 from the main pipeline 326 by the bridge plug 400 is advantageously monitored with a surface pressure gauge located at an installation on the tie-in line at the original point of entry of the coil tubing.

Figure 6:
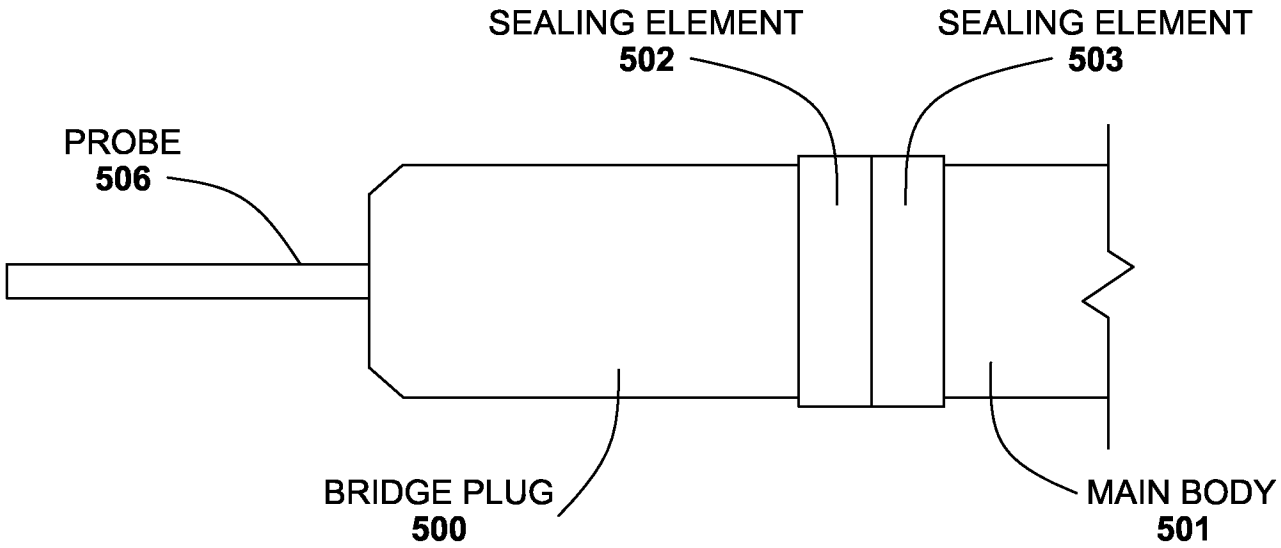
FIG. 6 is a side elevation view of another embodiment of a bridge plug 500.
Figure 7:
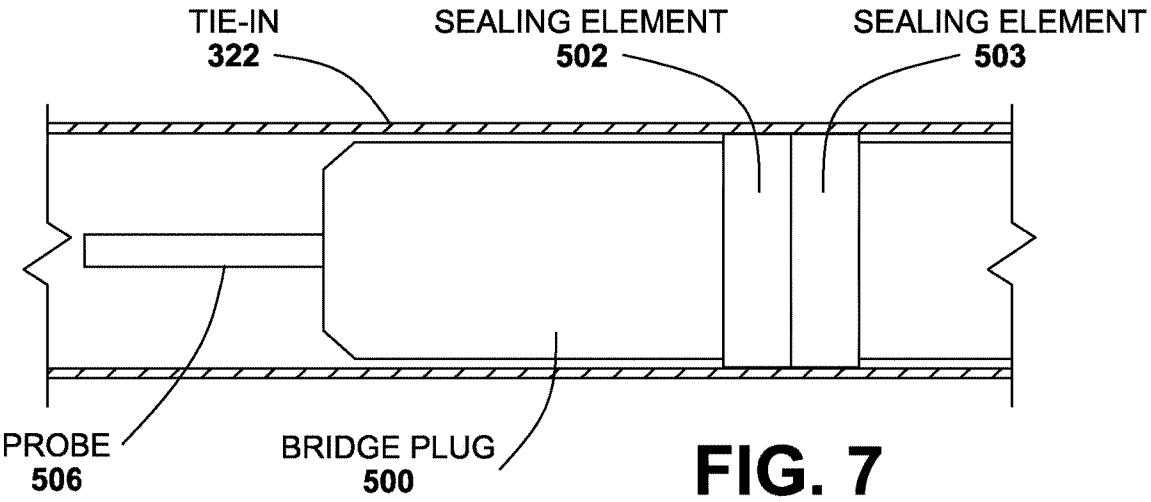
FIG. 7 is a partial side view of the bridge plug 500 of FIG. 6 inside a tie-in line 322.
Figure 8:
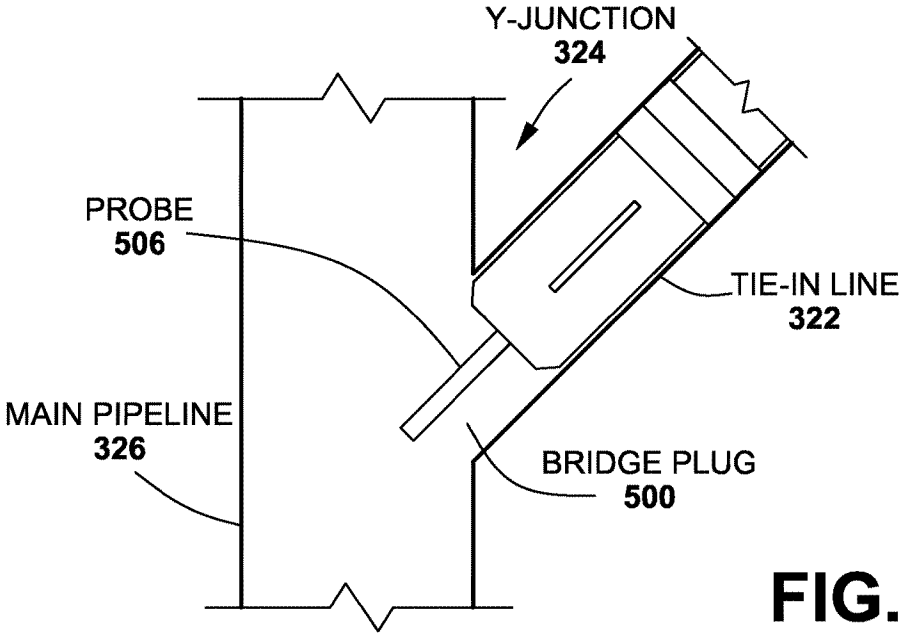
FIG. 8 is a partial side view of the bridge plug 500 arriving at a Y-junction 324.

A second embodiment of a bridge plug 500 is shown in FIG. 6. This embodiment also has a pair of sealing elements 502 and 503 arranged circumferentially around the main body 501 of the bridge plug 500 which will operate in a generally similar manner as described for the bridge plug 400 of FIGS. 4 and 5. In this embodiment, the mechanism for determining or confirming the location of the tie-in junction is provided by an outwardly extending probe 506. FIG. 7 shows the bridge plug 500 at a point when it is traveling through tie-in line 322 and FIG. 8 shows the bridge plug 500 as it reaches the Y-junction 324. It is to be understood that with further forward conveyance of the bridge plug 500, the probe 506 will encounter the inner sidewall of the main pipeline 326. At this point, the probe 506 is used to correctly space the sealable elements from the tie in intersection. Then sealable elements 502 and 503 are activated to seal the bridge plug 500 against the inner sidewall of the tie-in line 322. This isolates flow of hydrocarbons from the main pipeline 326 into the tie-in line 322. This process allows the well operator to properly suspend production of the well in accordance with regulations.

In one alternative embodiment of the bridge plug 500, the probe 506 is formed of a dissolvable material. This avoids the permanent presence of a probe extending into the main pipeline 326. The dissolvable probe may be formed of any material which is dissolvable in pipeline fluid at a suitable rate. This material may be selected on the basis of tests performed by a person having ordinary skill in the art which will not require undue experimentation.

Locating and Cleaning Assembly

Prior to suspension of operation of a tie-in line of a production well, it is desirable to clean the tie-in line to minimize the chances of corrosion occurring during the suspension period and improve the successful setting of the plug. The inventor has recognized that this cleaning step can be advantageously combined with an initial locating step to remotely determine the location of the tie-in junction prior to deployment of the bridge plug to isolate the tie-in line from the main pipeline. An example of a locating and cleaning assembly for performing the cleaning and locating tasks is shown in FIG. 9.

Figure 9:
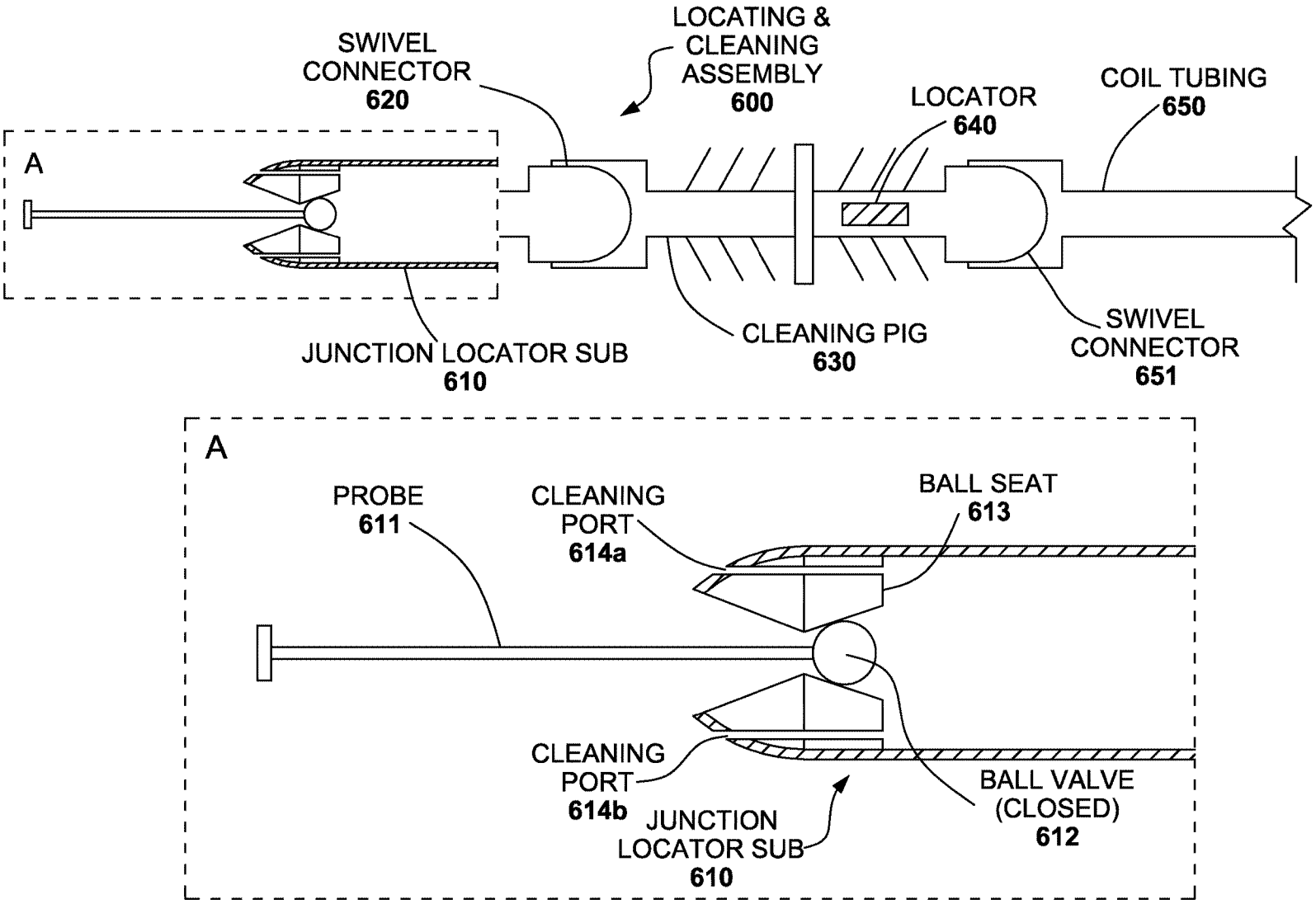
FIG. 9 a partial side view of a locating and cleaning assembly 600 with inset A indicating detail of the junction locator sub 610.

This embodiment of the locating and cleaning assembly 600, includes a junction locator sub 610 which is shown in a magnified view in inset A in FIG. 9. The junction locator sub includes a forwardly extending probe 611 with a ball valve 612 at its rearward end. The ball valve 612 is in the closed position in a ball seat 613 when the assembly 600 is travelling through the tie-in line and the probe 611 is not encountering significant resistance. The function of the probe 611 and ball valve 612 will be described in more detail hereinbelow with respect to FIGS. 10-12.

Figure 10:
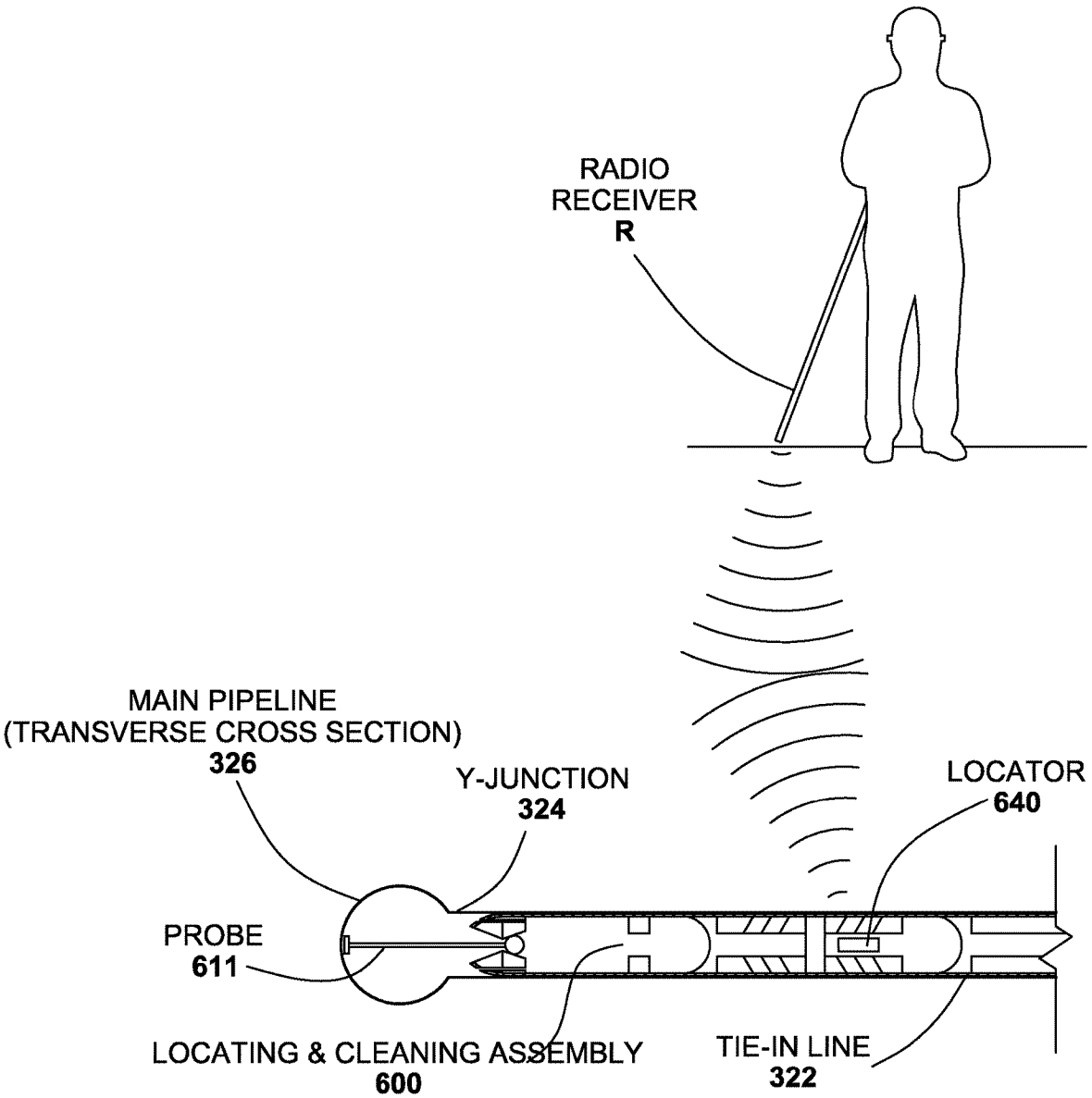
FIG. 10 is a schematic illustration of detection of the location of the locating and cleaning assembly 600 by the locator 640 at the point when the probe 611 reaches the opposite wall of the main pipeline 326.

The junction locator sub 600 has a pair of forward cleaning ports 614*a* and 614*b* for exit of pressurized gas which acts to clean the assembly itself as well as the interior of the pipeline. The junction locator sub 610 is provided with a swivel connector 620 for connection to a pipeline cleaning component which is known in the art as a "cleaning pig." The cleaning pig 630 forms an intermediate portion of the assembly 600. In this particular embodiment, the cleaning pig 630 has a locator 640 attached thereto. The locator 640 may be a pipeline logging transmitter or sonde which generates signals detectable by a radio receiver R at the surface as shown in FIG. 10. The cleaning pig 630 is connected to the coil tubing 650 used for conveyance of the assembly 600 via a swivel connector 651. While the locator 640 is shown in association with the cleaning pig 630, it may be possible to attach the locator 640 to a different component of the assembly 600, such as the junction locator sub 610, for example.

FIG. 10 provides an illustration of how the locating and cleaning assembly detects the location of the junction of a tie-in line 322 with the main pipeline 326 (shown in transverse cross section. When the probe 611 encounters the inner sidewall of the main pipeline 326, the ball valve 612 is forced to move away from its seat 613 and thus releasing pressure from the assembly. This pressure drop is detected at the surface and triggers a signal to be transmitted by the locator 640 to identify the location of the tie-in junction 324.

Figure 11A:
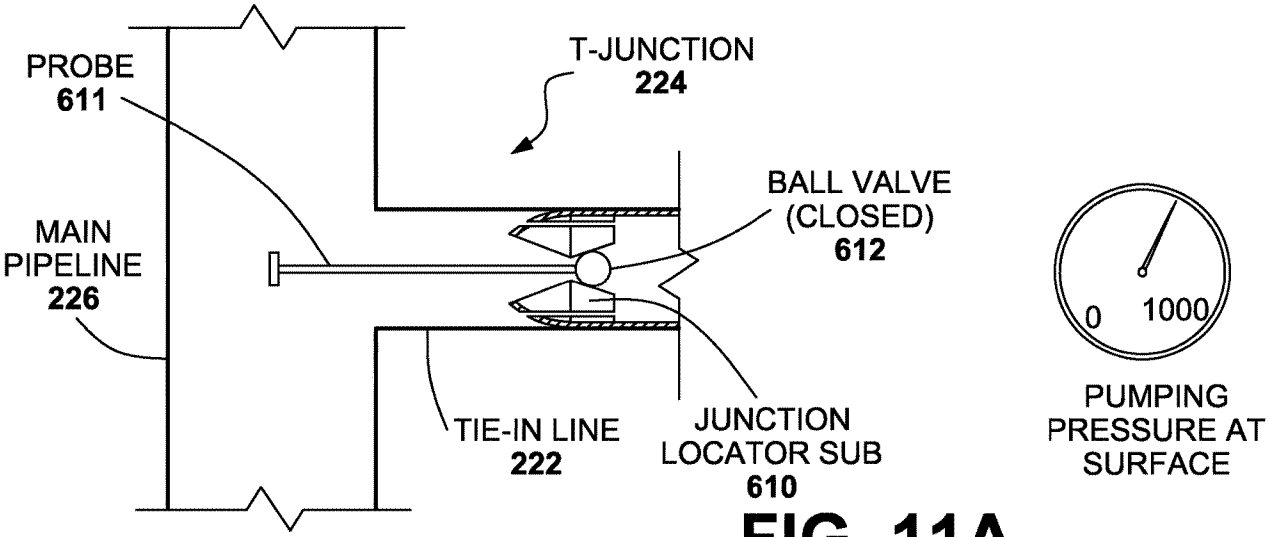
FIG. 11A is a side view of a T-junction 224 with the forward end of the junction locator sub 610 of the locating and cleaning assembly 600 in the tie-in line 222 prior to contact of the probe 611 with the opposite wall of the main pipeline 226. The ball valve 612 is closed.
Figure 11B:
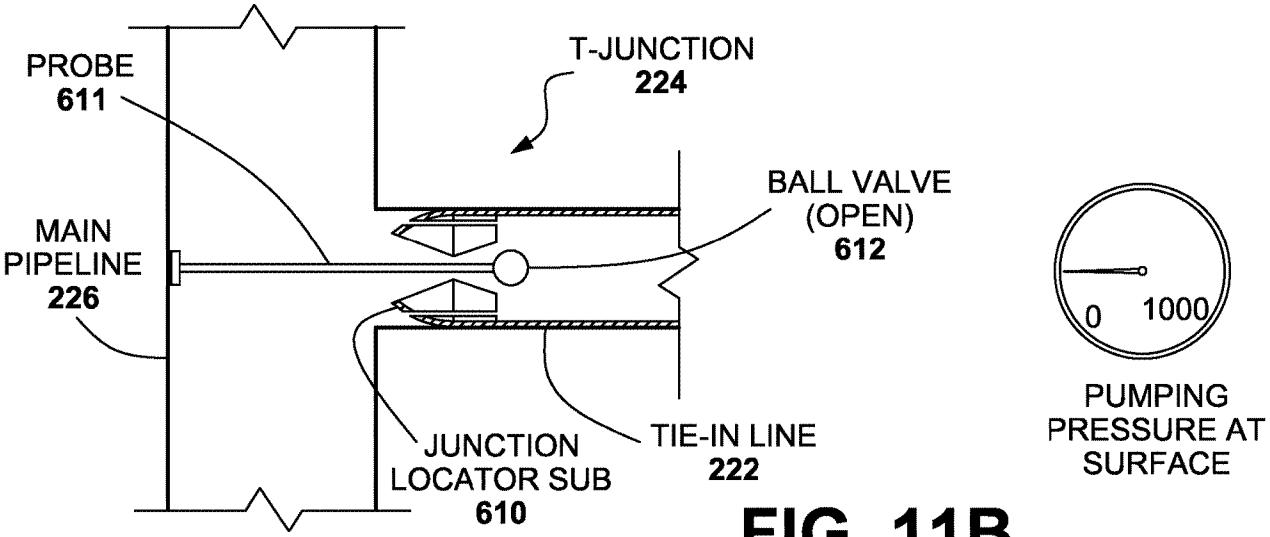
FIG. 11B is a side view of a T-junction 224 with the forward end of the junction locator sub 610 in the tie-in line 222 with the probe 611 in contact with the opposite wall of the main pipeline 226 triggering opening of the ball valve 612.
Figure 12A:
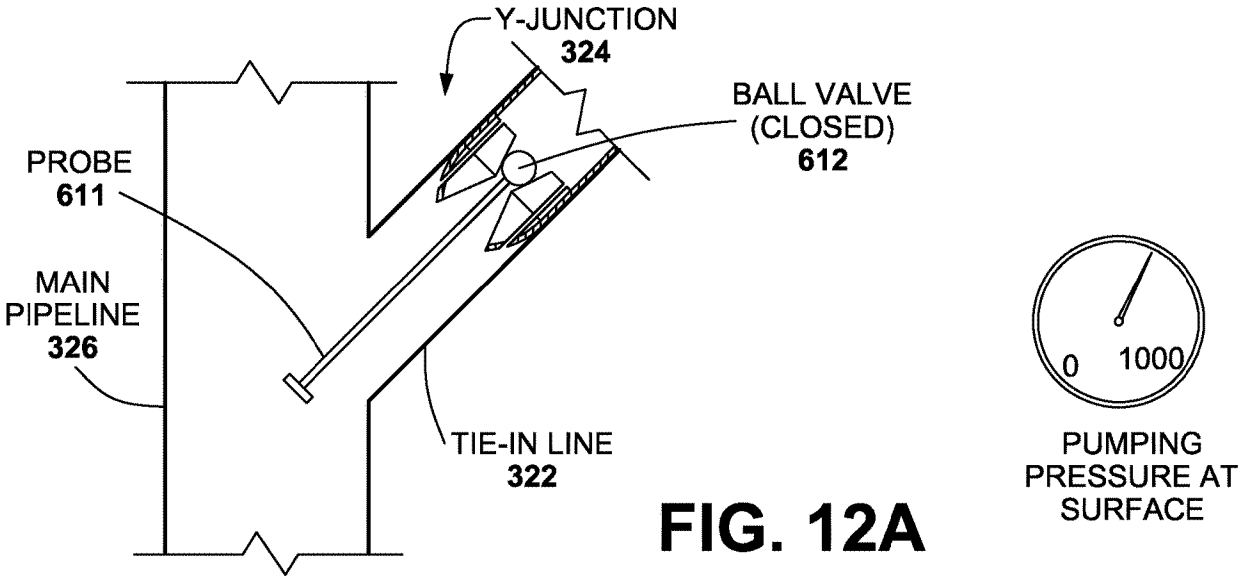
FIG. 12A is a side view of a Y-junction 324 with the forward end of the junction locator sub 610 in the tie-in line 322 prior to contact of the probe 611 with the opposite wall of the main pipeline 326. The ball valve 612 is closed.
Figure 12B:
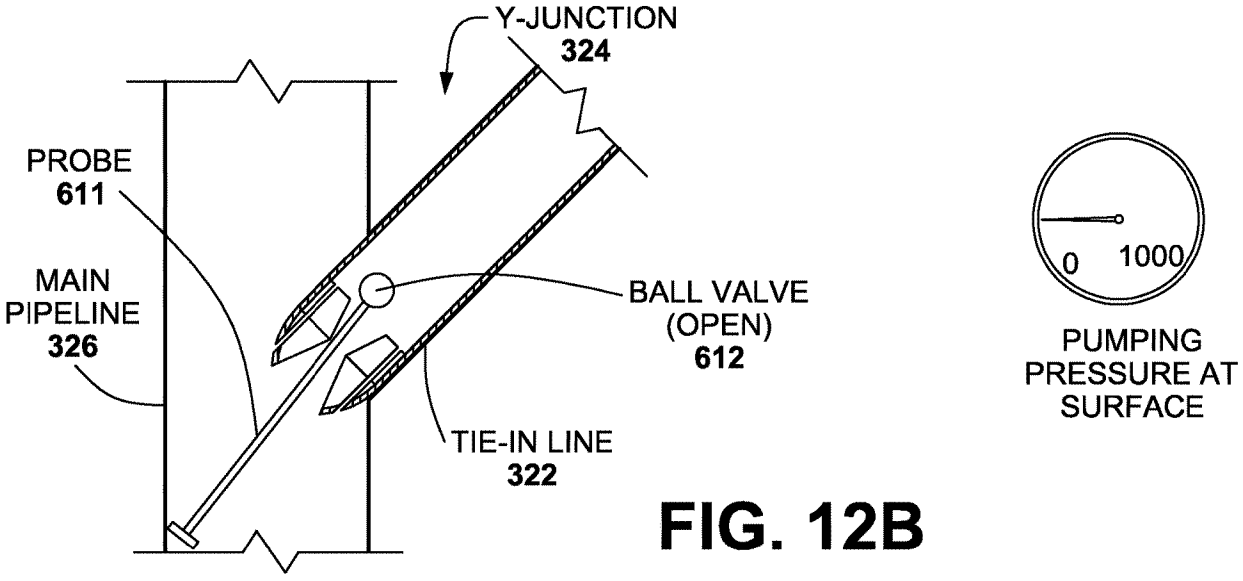
FIG. 12B is a side view of a Y-junction 324 with the forward end of the junction locator sub 610 in the tie-in line 322 with the probe 611 in contact with the opposite wall of the main pipeline 326 triggering opening of the ball valve 612.

FIGS. 11 and 12 illustrate the action of the ball valve 612 at a T-junction 224 and at a Y-junction 324, respectively. It is seen in both cases that a pressure drop is detected at the surface when the probe 610 encounters the inner sidewall of the main pipeline 226 of the T-junction 224 (FIG. 11B) and the main pipeline 326 for the Y-junction 324.

Example 1: Locating, Cleaning and Isolation of a Tie-In Line During Suspension of a Pipeline An example process for preparing a tie-in line for suspension will now be described. With the decision to suspend production of a producing well, the flow of hydrocarbons to the wellhead is stopped. Then a locating and cleaning assembly such as the assembly 600 of FIG. 9 is attached to the forward end of a spool of coil tubing and conveyed into the tie-in line. It is possible in some cases that partial excavation of the tie-in at the point of entry will be required to improve its configuration for entry of the assembly and coil tubing, particularly if there is a significant bend of the tie-in line at the desired entry point.

When appropriate entry of the cleaning and locating assembly into the tie-in line is established, this assembly is conveyed through the tie-in line to clean hydrocarbons and deposits from the tie-in line. When the probe of the assembly reaches the inner sidewall of the main pipeline, a sensor detects this contact and as a result, there is a pressure release in the assembly which is detected at the surface. At this point, the locator transmits a signal to indicate that the tie-in junction has been reached. This provides a first indication of the location of the tie-in junction. The locating and cleaning assembly is then withdrawn from the tie-in line.

In a subsequent step, a retrievable bridge plug with a mechanism for locating the tie-in junction is conveyed to the tie-in junction using coil tubing. When the mechanism for locating the tie-in junction is triggered, the sealing elements of the bridge plug are remotely activated to isolate the tie-in line from the main pipeline, thereby preventing entry of hydrocarbons into the tie-in line. This system provides two independent determinations of the location of the junction, providing increased confidence that the location of the junction has been correctly determined.

Equivalents and Scope

The terms "one," "a," or "an" as used herein are intended to include "at least one" or "one or more," unless otherwise indicated.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this technology belongs.

While this technology has been particularly shown and described with references to embodiments thereof, it will be understood by those skilled in the art that various changes in form and details may be made therein without departing from the scope of the disclosure encompassed by the appended claims.

The invention claimed is:

1. A method for isolating a horizontal tie-in pipeline of an inactive hydrocarbon-producing well from a main pipeline to prevent flow of hydrocarbons into the tie-in pipeline, the method comprising:

a) identifying a location of a junction of the tie-in pipeline and the main pipeline and cleaning the tie-in pipeline by deploying a locating and cleaning assembly into the tie-in pipeline, the locating and cleaning assembly including a pipeline junction sensing element longitudinally extending from a forward end of the locating and cleaning assembly, the sensing element connected to a valve which, when open, relieves pressure in the locating and cleaning assembly as an indicator of the location of the junction;

b) withdrawing the locating and cleaning assembly;

c) deploying a plug device having a longitudinally extending forward probe and a sealing element to the location of the junction; and d) remotely actuating the sealing element.

2. The method of claim 1, wherein the probe is dissolvable in hydrocarbons.

3. The method of claim 1, wherein the locating and cleaning assembly further includes a radio transmitter to indicate or confirm the location of the junction.

4. The method of claim 1, wherein the locating and cleaning assembly includes one or more ports adjacent to the sensing element, for exit of pressurized gas to clean the locating and cleaning assembly and the tie-in pipeline.

5. The method of claim 1, wherein the locating and cleaning assembly is deployed to the junction using coiled tubing.

6. The method of claim 5, wherein the pressure in the locating and cleaning assembly is sensed at surface via the coiled tubing.

7. The method of claim 1, wherein the sealing element is configured to be deactivated and the plug is configured to be retrieved to reactivate the tie-in pipeline.

8. The method of claim 1, further comprising the step of pumping liquid or gas out of the tie-in pipeline after the step of remotely actuating the sealing element.

9. The method of claim 8, further comprising pumping preservative liquid or gas into the tie-in pipeline.

10. The method of claim 1, wherein the pipeline junction sensing element is connected to a separate cleaning component using a swivel connector.

11. The method of claim 10, wherein the separate cleaning component includes a radio transmitter to indicate or confirm the location of the junction.

12. The method of claim 10, wherein the separate cleaning component is configured for connection to coiled tubing using a second swivel connector.

* * * * *